US005418857A

United States Patent [19]

Eatwell

[11] Patent Number: 5,418,857

[45] Date of Patent: May 23, 1995

[54] ACTIVE CONTROL SYSTEM FOR NOISE SHAPING

[75] Inventor: Graham P. Eatwell, Cambridge, United Kingdom

[73] Assignee: Noise Cancellation Technologies, Inc., Linthicum, Md.

[21] Appl. No.: 127,541

[22] Filed: Sep. 28, 1993

[51] Int. Cl.[6] ..... G10K 11/16

[52] U.S. Cl. ..... 381/71

[58] Field of Search ..... 381/71, 94

[56] References Cited

U.S. PATENT DOCUMENTS

| | | | |
|---|---|---|---|
| 4,153,815 | 5/1979 | Chaplin et al. . | |
| 4,490,841 | 12/1984 | Chaplin et al. . | |
| 4,677,677 | 6/1987 | Eriksson | 381/71 |
| 5,091,953 | 2/1992 | Tretter | 381/71 |

OTHER PUBLICATIONS

K. J. Astrom, B. Wittenmark, *Adaptive Control,* (1989), (Table of Contents only).

B. Widrow, S. D. Stearns, *Adaptive Signal Processing,* Prentice hall, (1985), (Table of Contents only).

Sjosten, et al., "Proceedings of Inter-Noise 90," Gothenberg, Sweden, 1251-1254 (1990).

Widrow & Stearne, Adaptive Signal Procssing, 1985, pp. 294-297.

*Primary Examiner*—Forester W. Isen

*Attorney, Agent, or Firm*—James W. Hiney

[57] ABSTRACT

A method and system for altering the frequency or harmonic spectra of a disturbance characterized by an output generator (26) and a response generator (24) that cooperate to produce shaped control signals in response to first input signals (23).

30 Claims, 6 Drawing Sheets

ACTIVE CONTROL SYSTEM FOR NOISE SHAPING

BACKGROUND

In designing exhaust silencers or mufflers for automobiles, the quality or timbre of the residual noise is often as important as the overall power level. The noise is characterized by a fundamental period which is related to the rotation rate of the engine, so the frequency spectrum has peaks at multiples of a fundamental frequency. This frequency changes as the speed of the engine changes. The frequency spectrum of the noise can be altered by the design of the passive silencer, but the quality of the noise is related to the relative levels of the various harmonics in the noise which cannot be controlled by a passive silencer.

Active noise cancellation techniques have been applied to automobile exhausts. These techniques seek to reduce the exhaust noise by adding noise with an equal amplitude but opposite phase. The system comprises an actuator, such as a loudspeaker or flow modulator, a sensor to monitor the residual noise and an electronic control system to determine the required drive signal for the actuator. The input to the control system can be a frequency or phase signal from a tachometer or the input can be from a sensor which is responsive to the sound pressure in the exhaust pipe or the input can be from the residual sensor itself (or it can be from a combination of these).

Active noise cancellation techniques seek to cancel as much of the offending noise as possible. The residual noise has an unpredictable quality and, although the total power is reduced, the residual noise may be subjectively worse than the original noise.

In the case of automotive mufflers or silencers, it is often not desirable to have a completely silent exhaust, since the quality of the exhaust noise will affect the character of the automobile.

There are many other applications where it is thought to be beneficial to adjust the frequency or harmonic content of a noise. These include noise inside aircraft and vehicle cabins. There is therefore a desire to be able to control the quality or shape of noise.

Control techniques have been used extensively in the areas of flight control and process control. One such technique is that of model reference control. In this approach the desired relationship between the input (command) signals and the system response is known in advance (this relationship is the 'model'). An example of this type of system is shown in FIG. 1. The input signal, 1, is applied to both the physical system, 20, (via a regulator, 4) and to the model system, 21. The difference between the desired response, 6, and the actual physical response, 3, is used to generate an error signal, 22. The error signal and the input signal are used in adaption unit, 7, to adjust the regulator 4. (See Astrom and Wittenmark, 'Adaptive Control', Addison-Wesley Publishing Company, 1989, Section 1.2 for example, FIG. 1.2 in particular). These methods are designed to alter the effective response of the physical system, whereas the noise shaping control system of this invention is designed to alter the characteristics of a disturbance (there is no disturbance shown in FIG. 1, but this style of control system is usually designed to be insensitive to any disturbances).

The quality of a noise is best characterized by the shape of the frequency spectrum. There are several known techniques for canceling noise using frequency domain methods.

One approach is shown in FIG. 2. A reference input signal, 1, is input to a filter, 4, to produce the output signal, 2. An error signal, 3, related to the performance of the system is transformed in forward transform module, 6, to give the frequency spectrum of the error signal, 11. The input signal, 1, is transformed in forward transform module, 9, to give the frequency spectrum, 12. The frequency signals 11 and 12 are used in adaption unit 7 to estimate the transform of the filter response, 13. An inverse transform is applied in module 5 to provide a new filter characteristic.

An alternative approach is shown in FIG. 3. This configuration is the same except that the filtering is also performed in the frequency domain. The transform, 12, of the input signal is used together with the frequency domain filter, 4, to calculate the transform, 10, of the desired output signal. The inverse transform is then applied at 5 to produce the final output signal, 2.

A variation of this approach is shown in FIG. 4. This approach, which is designed for canceling periodic noise, is disclosed in U.S. Pat. No. 4,490,841 to Chaplin et al. The frequency transforms of 5 and 6 are synchronized to the frequency, 8, of a noise source. This means that the output of transform module 6 provides the complex amplitudes of the harmonic components of the residual signal, 3. This approach has been applied successfully to muffler noise cancellation where the frequency signal is provided by a tachometer signal.

The system is equivalent to using an input signal with a unity harmonic spectrum. The reference input, 1, is shown for comparison to the other schemes. It is not a physical input.

This technique provides a means for canceling selected harmonics of the noise, but there is no mechanism for determining or controlling the degree of cancellation.

One of the common adaption algorithms used in the adaption module is the filtered-input (filtered-x) LMS algorithm (Widrow and Steams, 'Adaptive Signal Processing', Prentice Hall, 1985, p288–294). One feature of this algorithm is that the adaption rate is dependent on the level and frequency content of the input signal. In the approach disclosed by Sjösten et al, (Proceedings of Inter-noise 90, Gothenburg, Sweden, 1990, pp1251–1254) the input signal is a sum of sinusoids synchronized to the frequency of the engine. By adjusting the relative levels of these input signals the relative rate of adaption of the harmonics can be varied. This approach has limited use since the adaption rate alone does not determine the levels of residual noise.

In other approaches the harmonics are controlled separately, so a different adaption step size can be used for each harmonic to control the relative rate of adaption.

However, neither of these approaches directly govern the amount of cancellation of the harmonics. For example, for a steady signal they will still attempt to cancel all of the noise and for transient signals the reduction will depend on the rate of change of the noise.

Another approach for altering the levels of the residual noise requires that the desired residual signals are known in advance. This method can be used for periodic or broadband noise. The desired signal can be subtracted from the residual signal before being used in the adaption algorithm. However, it is not practical to supply a desired signal for the whole range of operating conditions.

OBJECTS OF THE INVENTION

One object of this invention is to provide a system and method for adjusting the frequency content of a disturbance by use of active control.

Another object of this invention is to provide a system and method for independently controlling the amount of cancellation of each frequency component of a disturbance so as to affect the relative levels of the components.

A further object of this invention is to provide a system and method for controlling the relative amplitudes of the harmonics of a disturbance.

A still further object of this invention is to provide a model reference control system for active control for altering the frequency response of an acoustic system.

And yet a further object of this invention is to provide a model reference control system for active control for controlling the harmonic response of an acoustics system.

An additional object of this invention is to provide a method and system to govern the amount of cancellation of harmonics.

These and other objects of the invention will become apparent when reference is made to the following drawings in which:

List of Figures

SUMMARY OF THE INVENTION

Figure 1:
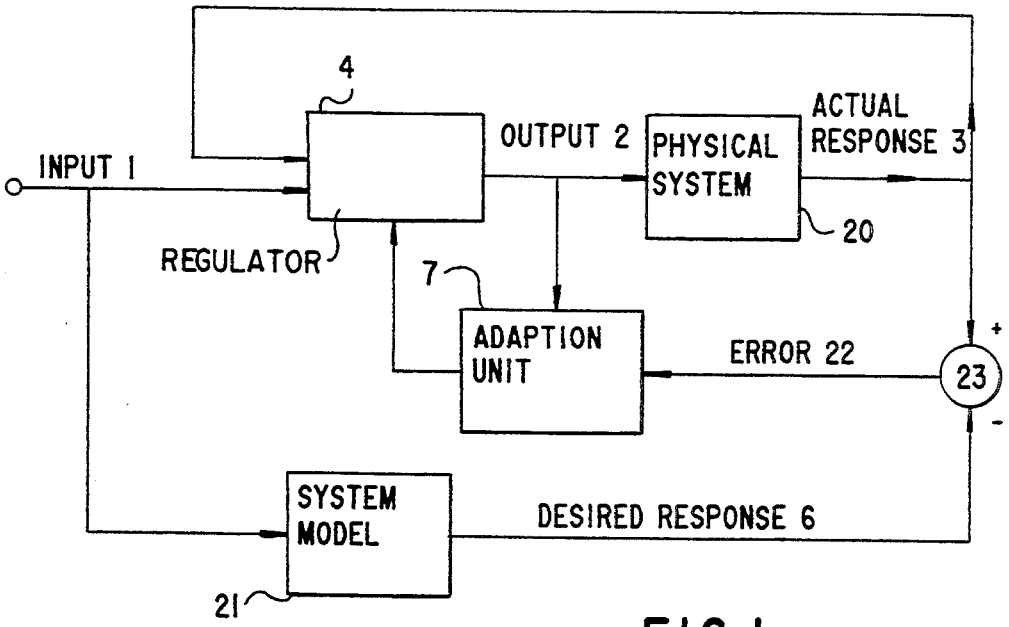
FIG. 1 is a diagrammatic view of a known model reference control system.
Figure 2:
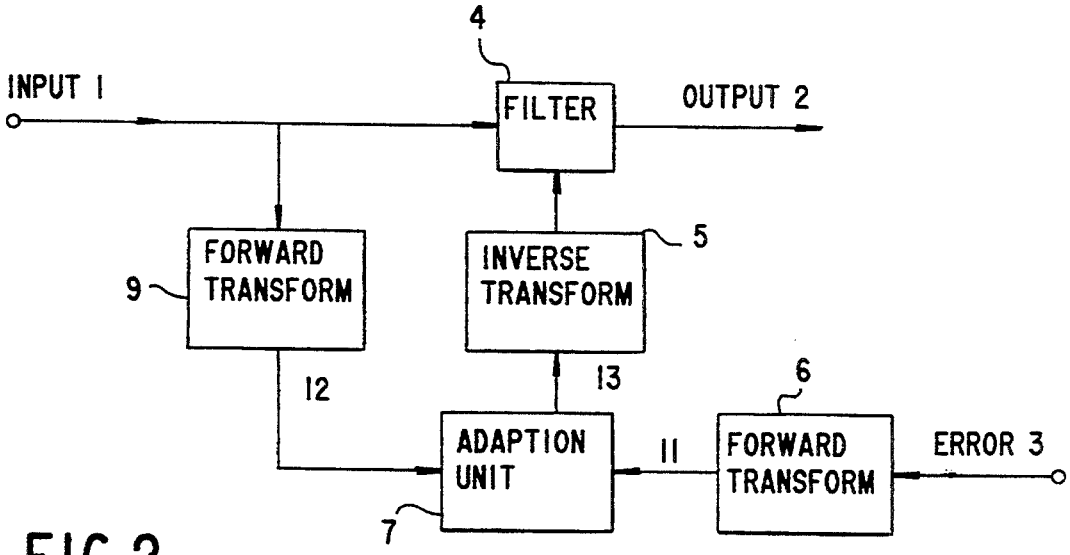
FIG. 2 is a diagrammatic view of a first known control system with frequency domain adaption.
Figure 3:
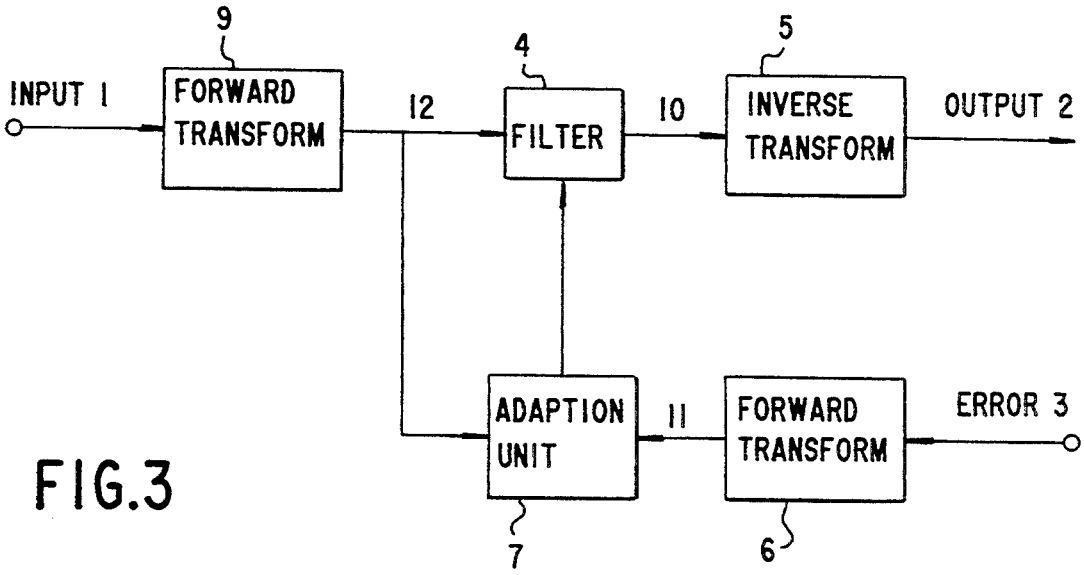
FIG. 3 is a diagrammatic view of a second known control system with frequency domain adaption and filtering.
Figure 4:
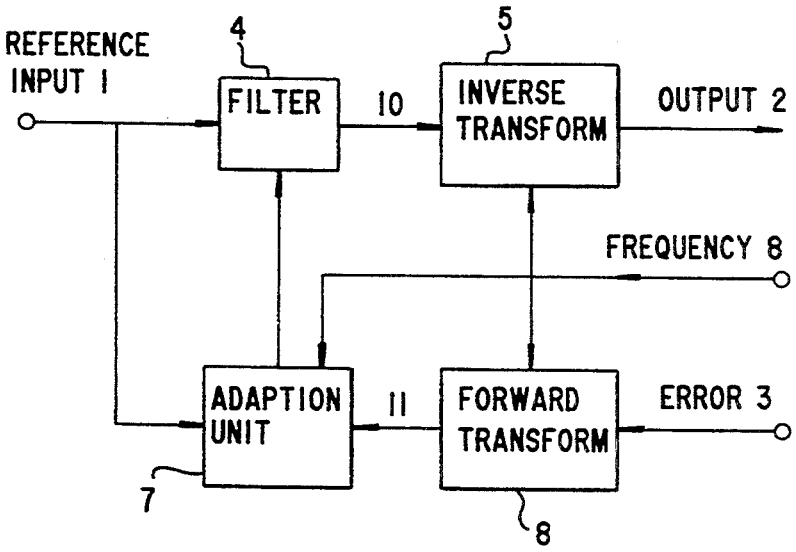
FIG. 4 is a diagrammatic view of a known patented control system for canceling periodic noise.
Figure 5:
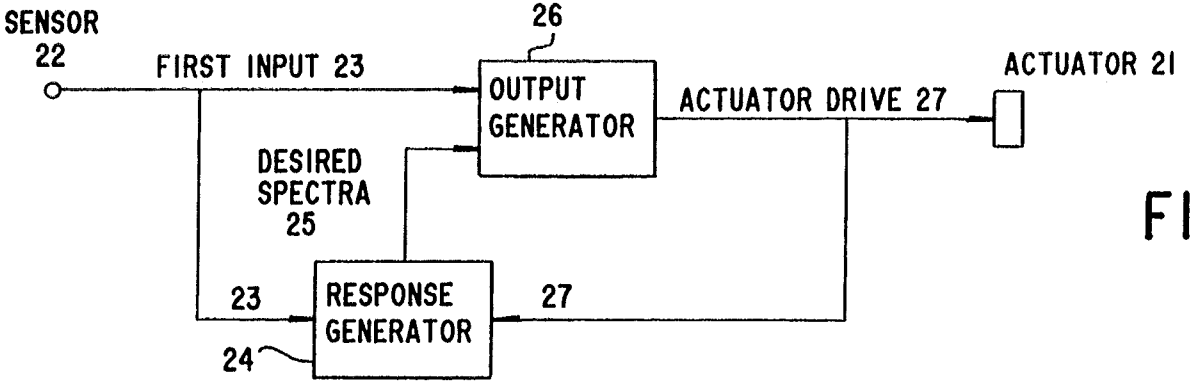
FIG. 5 is a diagrammatic view of a frequency shaping control system of the current invention.

The invention relates to a control system for altering the frequency or harmonic spectra of a disturbance. A diagrammatic view of the basic system is shown in FIG. 5. It comprises at least one actuator means, 21, for providing a controlling disturbance, at least one sensor means, 22, responsive to the controlled disturbance and producing first input signals, 23. These first signals will also be referred to as residual signals. The system also includes response generator means, 24, for producing second signals, 25, characterizing the desired disturbance, and output generator means, 26, adapted in response to said first signals and said second signals and producing drive signals, 27, for said actuator means.

The disturbance may take a variety of forms including, but not limited to, sound, vibration or electrical signals. The control system may be configured to control different types of disturbances simultaneously. Examples of actuators include loudspeakers, shakers and electrical circuits. Examples of sensors include microphones, accelerometers, force sensors, etc.

Examples of known output generators include analog and digital filters, waveform synthesizers and neural networks.

The response generator, 24, constitutes one part of this invention. It is responsive to signals derived from the first (sensor) signals and the actuator drive signals and produces the second signals which characterize the target or desired disturbance.

The output generator, 26, is configured so as to produce an actuator drive signal that will cause the controlled disturbance to have a characteristic close to the desired or target disturbance.

DETAILED DESCRIPTION OF THE INVENTION

Some aspects of the invention will now be described in more detail for a multi-channel control system. The operation of the control system is more easily described in the frequency domain, but the actual implementation can be in the frequency domain or the time domain.

The residual signal from each of the residual sensors and each of the input signals can be converted to the frequency domain by a number of techniques. The frequency resolution can be fixed as in a Fourier transform or, as in U.S. Pat. No. 4,490,841 or as in PCT application number PCT/US92/05228 to Eatwell; the frequency resolution can be determined by the fundamental frequency of the disturbance. Heremattter, the Fourier transform at fixed frequencies shall be called a frequency transform and the transform at frequencies determined by the frequencies of the disturbance shall be called a harmonic transform.

At each frequency the components from the input and residual sensors can be written compactly as a vectors, u and e, respectively, of complex values. These values are related to the complex frequency components of the output or drive signals, x, at the corresponding frequency and to the components of the original (uncontrolled) noise, y , by the relationship $$e_m(k) = \sum_{l=1}^{L} A_{ml}(f)x_l(k) + y_m(k) \text{ or } e = Ax + y, \tag{1}$$

where m is the sensor number, l is the actuator number, f is the frequency and k is the frequency (harmonic) number. L is the total number of actuators and A is the forward transfer function matrix of the physical system at the appropriate frequency, f.

Output Generator

The function of the output generator is to produce the vector of drive signals, x. The drive signals may be obtained by triggering a stored waveform, as in U.S. Pat. No. 4,153,815, or by multiplying the transforms of the reference signals by a complex matrix C, so that $$x_l = \sum_{n=1}^{N} C_{ln}\hat{u}_n \text{ or } x = C\hat{u}, \tag{2}$$

where n is the reference signal number and N is the total number of reference signals. The matrix multiplication corresponds to a set of convolutions in the time domain.

The reference signals, u, may be sinusoidal signals with constant amplitude and/or constant frequency or harmonic transform values. In either of these embodiments the output generators are known as waveform generators. Alternatively, one or more reference sensors may be used to provide input signals. The transformed signals, w, from the set of reference sensors can be written as $$w=Dx+u, \tag{3}$$

where the transfer function matrix, D, denotes the feedback (if any) from the actuators to the reference sensors, and u denotes the part of the signal due to the original disturbance.

The reference signals may be estimated from the input signals, w, and the output signals, x, using $$\hat{u}=w-\hat{D}x, \tag{4}$$

where $\hat{D}$ is an estimate of the transfer function matrix D. When these reference signals are related in phase and amplitude to the noise to be controlled the output generator is called a filter.

Some of the residual sensors may be used simultaneously as reference sensors (as in a feedback control system), or additional sensors can be used to provide reference signals (or a combination of both residual and additional sensors can be used). For example, additional sensors may be positioned so as to give advance information on the disturbance.

Adaption of the Output Generator

In an active cancellation scheme the desire is usually to reduce the sum of squares of the residual. The performance is measured by the scalar cost function $$E=e^*e, \tag{5}$$

where the superposed star denotes conjugate transpose of the complex vector. This cost function depends only on the level of the residual signals.

The control system is never perfect, so there is always some residual noise. In many applications the characteristics of this residual noise are important. For example, when the lowest tonal component of a periodic signal is canceled it often seems that the next tone becomes louder.

It is one aspect of this invention that the control system is configured to drive the residual noise to some desired level, $y_d$. This desired level is determined by a response generator. The usual cost function is replaced by a more general cost function which depends upon the known signals, i.e., the reference signals, the residual signals and the output signals $$E=E(w,e,x). \tag{6}$$

In particular, in the preferred embodiment, the cost function is given by a weighted sum of squares of the output signals, x, and the difference between the actual residual and the desired residual. This cost function is $$E=|e-y_d(u,y,e)|^2+\lambda|x|^2, \tag{7}$$

where the desired residual signal, $y_d(u,y,e)$, is dependent on the original signals, y, at the error sensors, and the reference signals, u. The parameter λ is a minimization constraint.

The actuator drive signals which minimize this cost function can be calculated from a single measurement, they are given by $$x_d=-B(y-y_d(u,y,e)), \tag{8}$$

where $$B=(A^*A+\lambda I)^{-1}A^*. \tag{9}$$

When these drive signals are used, the residual at the sensors is $$e_{opt}=Ax_d+y=(I-AB)y+ABy_d(u,y,e). \tag{10}$$

This demonstrates that the desired residual is only achievable when AB=I, the identity matrix.

However, the original and reference signals cannot be measured directly, except when there is no control output. Instead, the desired output is estimated as $$\hat{x}_d=-\hat{B}(\hat{y}-\hat{y}_d(\hat{u},\hat{y},e)). \tag{11}$$

where the estimate of the original signals, $\hat{y}$, can be obtained from the error signals, e, and the output signals, x, using $$\hat{y}=e-\hat{A}x, \tag{12}$$

and where $\hat{A}$ and $\hat{B}$ are estimates of A and B respectively.

For statistically stationary noise, the optimal frequency domain filter is given by $$C_{opt}=-(B(y-y_d(u,y,e))u^*).Q, \tag{13}$$

where the angled brackets denote the expected value and where Q is the inverse auto-correlation matrix of the inputs given by $Q=(uu^*)^{-1}$. The optimal time domain filter is subject to a causality constraint but can be similarly calculated in terms of the input and the desired residual.

This leads to frequency domain adaption formulae, such as $$C'=(1-\mu)C-\mu\hat{B}(\hat{y}-y_d(\hat{u},\hat{y}me)\hat{u}\ \hat{Q}, \tag{14}$$

where μ is the convergence step size, and $\hat{x}_d$ is given by equation (11). Thus, the output generator is adapted in response to the difference between the estimate of the original disturbance, $\hat{y}$, and the desired signals, $y_d$.

Equation (12) can be used to substitute for the estimate of the original disturbance, this gives an alternative form of the update equation $$C'=(I-\mu\Lambda)C-\mu\hat{B}(e-y_d)\hat{u}\ \hat{Q}, \tag{15}$$

where I is the identity matrix and the matrix leak, Λ, is given by $$\Lambda-I-\hat{B}\hat{A}. \tag{16}$$

In this form of the update equation the output generator is adapted in response to the difference between the residual signals and the desired signals.

Figure 6:
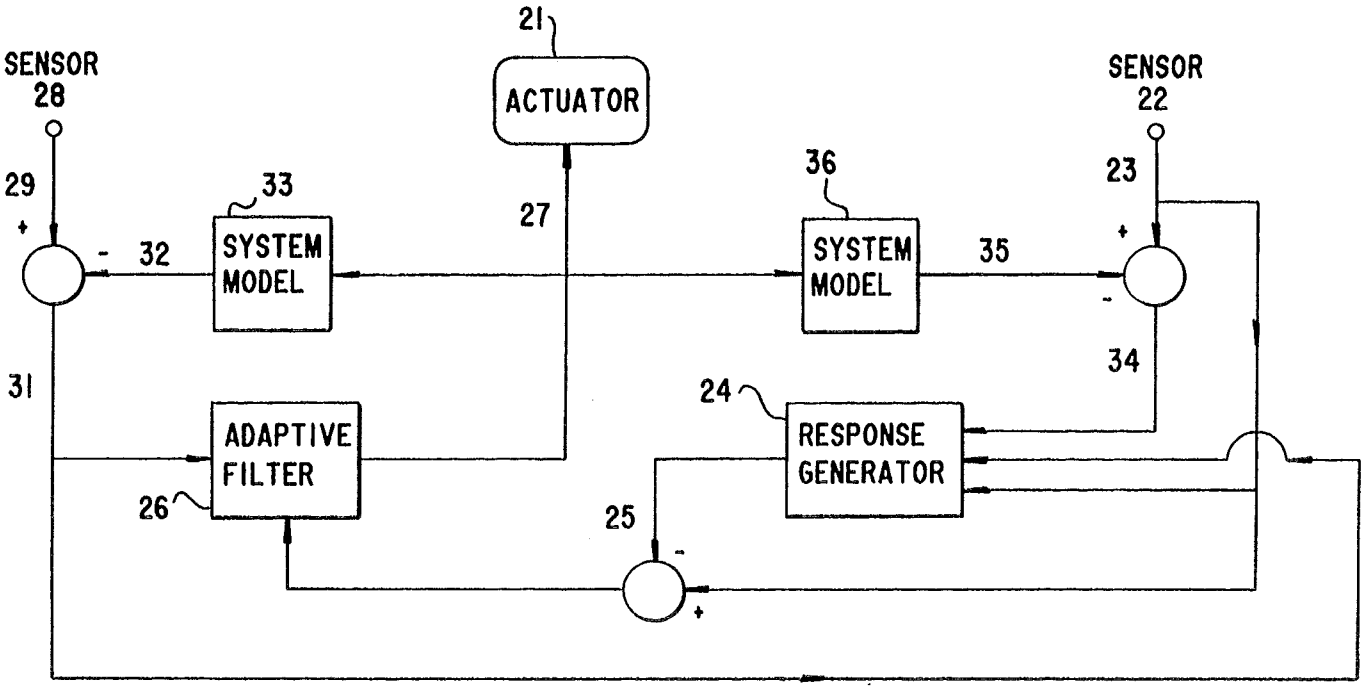
FIG. 6 is a diagrammatic view of a frequency shaping control system of the current invention using adaptive filters.

An example of this type of control system is shown in FIG. 6. Reference sensors, 28, provide input signals, 29.

Reference signals, 31 are obtained by subtracting estimates, 32, of the signals due to the controlling disturbance. These estimates are obtained by passing the drive signals, 27, through a model, 33, of the system feedback (which has transfer function $\hat{D}$). The adaptive filter, 26, is adapted in response to the difference between the desired signals, 25, and the measured residual signals, 23. The desired signals are produced by response generator, 24, which is responsive to the residual signals, 23, the reference signals, 31 and the estimated original signals, 34. The estimated original signals are produced by subtracting the estimates, 35, of the signals due to the controlling disturbance from the residual signals. These estimates are obtained by passing the drive signals, 27, through a model, 36, of the system feedback (which has transfer function $\hat{A}$). For a feedback system, sensors 28 and 22 are the same and signals 31 and 34 are the same so they need only be calculated once.

Figure 7:
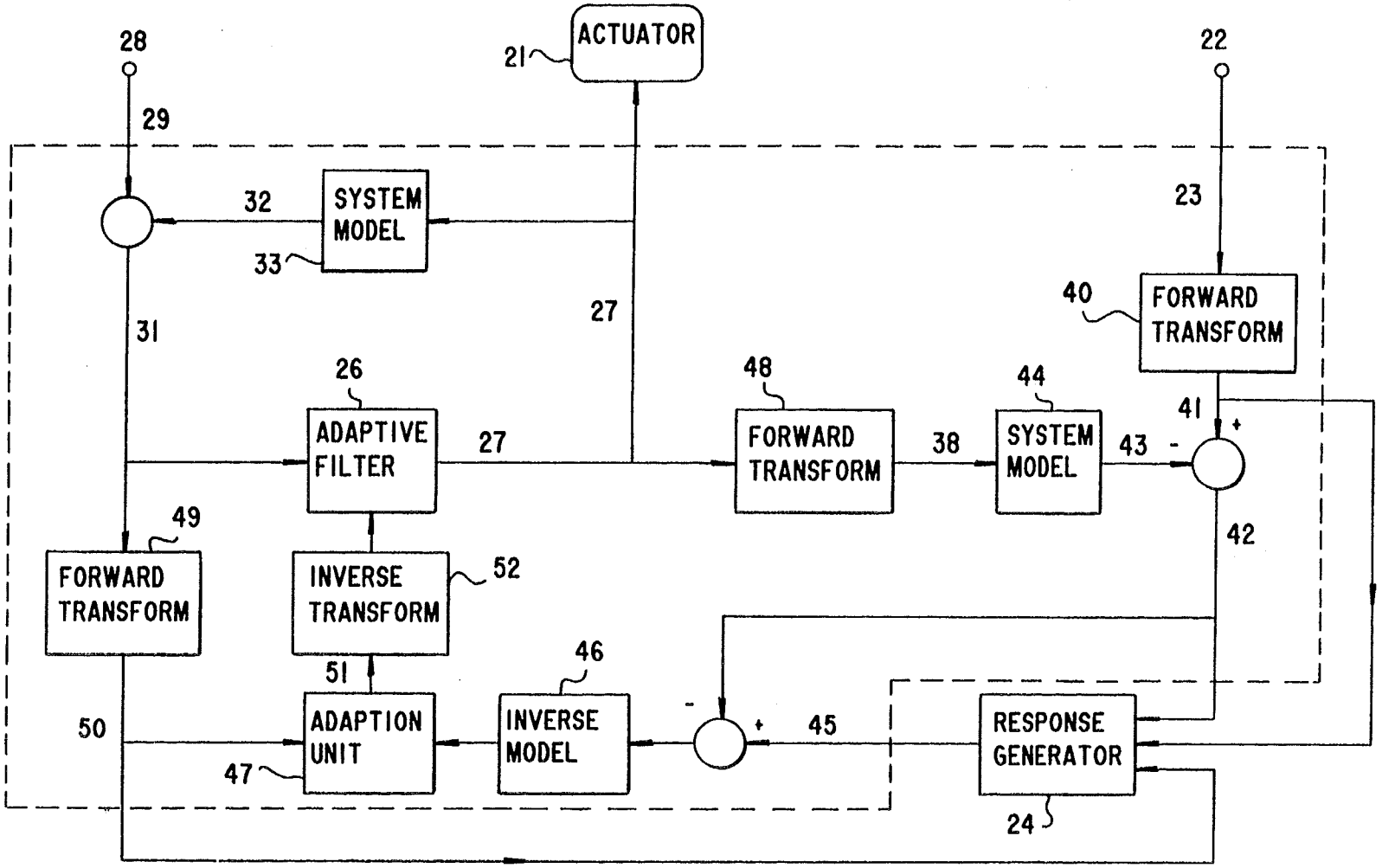
FIG. 7 is a diagrammatic view of a frequency shaping control system of the current invention using transform domain adaption of the adaptive filters.

A diagrammatic view of the control system using the frequency domain update given by equation (14) is shown in FIG. 7. The residual signals, 23, are transformed in transform module 40 to produce the transformed residual signals, 41 (e). The transform of the estimated original signals, 42 ($\hat{y}$) are produced by subtracting the transformed estimates, 43, of the signals due to the controlling disturbance from the residual signals. These estimates are obtained by passing the transformed drive signals, 38, through a model, 44, of the system feedback (which has transfer function $\hat{A}$). The transformed drive signals are produced by passing the actuator drive signals, 27, through forward transform module 48. The reference signals 31 are passed through forward transform module 49 to produce the transformed reference signals 50. The signals 41 and 42, together with the transformed reference signals, 50, are used in the response generator, 24, to determine the transform of the desired disturbance, 45. The difference between the signals 45 and the signals 42 is passed through the inverse transfer function model, 46 ($\hat{B}$) and used in adaption module 47 to adjust the transform of the filter coefficients 51. The inverse transform of these coefficients is calculated at 52 and used to update the coefficients of filter 26. This inverse transform should take account of the causality constraint on the filter and the effect of circular convolutions.

Figure 8:
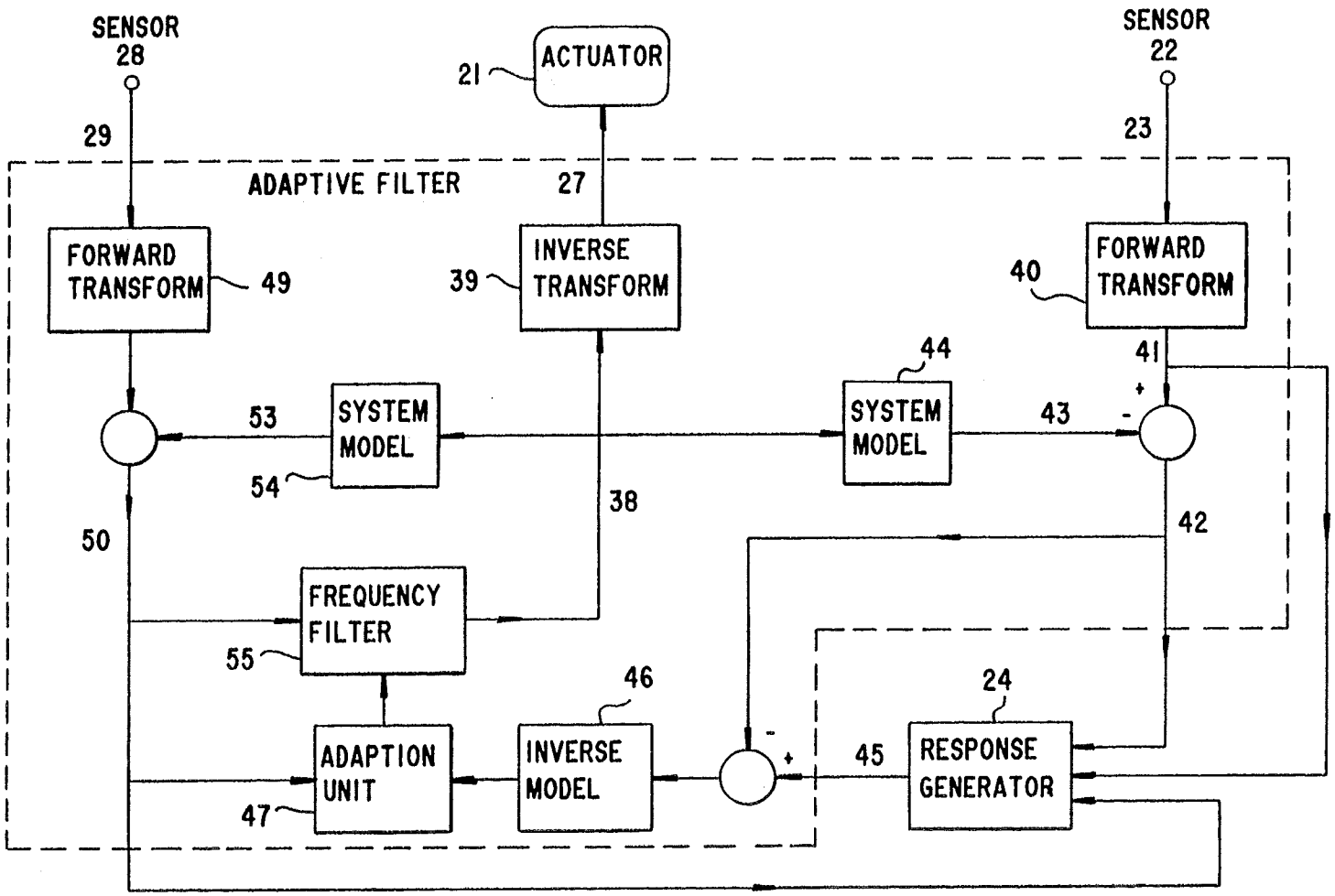
FIG. 8 is a diagrammatic view of a frequency shaping control system of the current invention using frequency domain adaptive filters.
Figure 9:
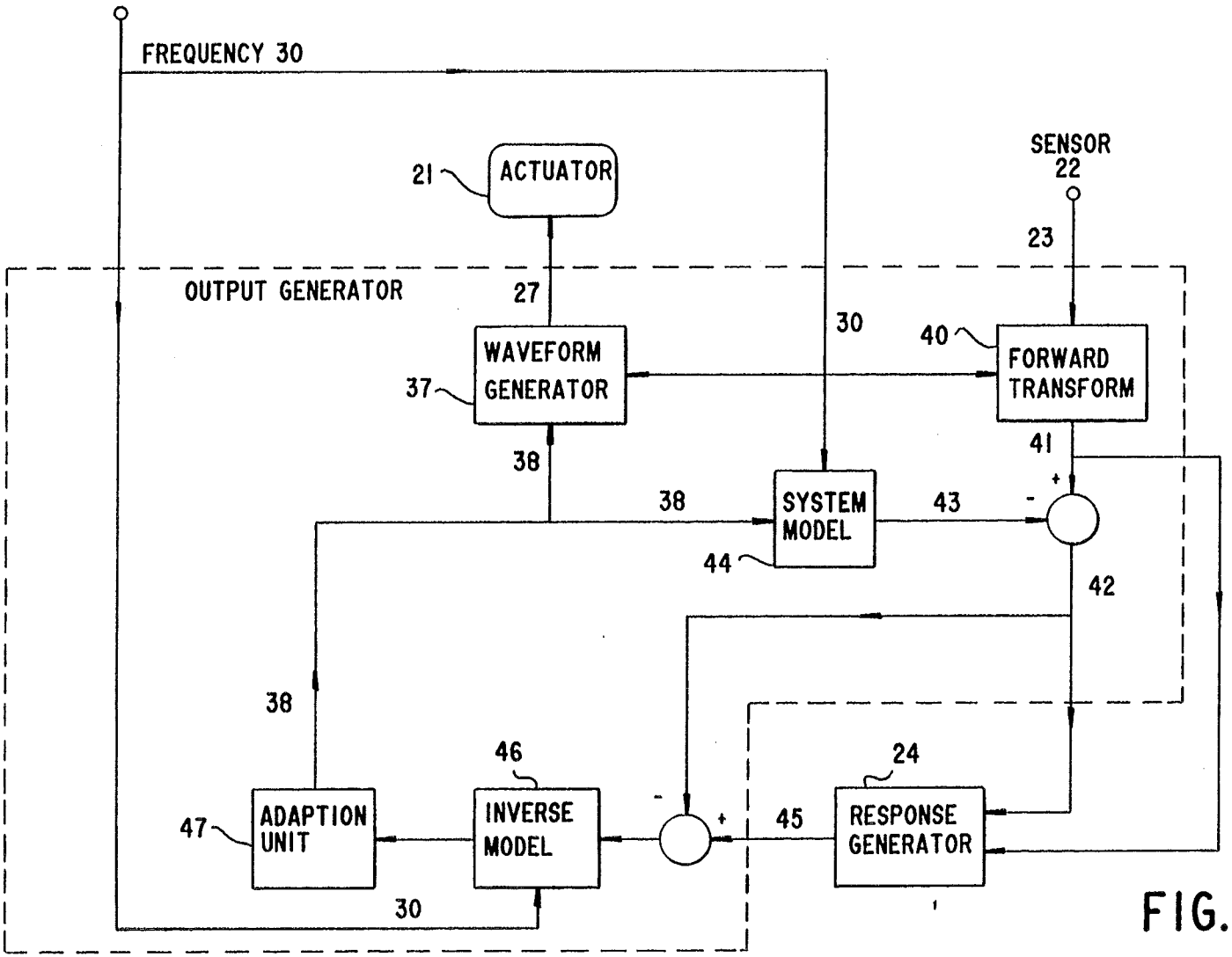
FIG. 9 is a diagrammatic view of a frequency shaping control system of the current invention using waveform generators and harmonic transforms.

Alternatively, the filter itself may also be performed in the frequency domain. A diagrammatic view of one embodiment of this type of system is shown in FIG. 8. The transform of the reference signal, 50, is obtained by passing the input signals, 29, through transform module 49 and subtracting off the transforms of the signals, 53, due to the controlling disturbance. These signals are produced by passing the transform of the drive signals, 38, through a frequency model, 54, of the system feedback (which has transfer function $\hat{D}$). The transformed drive signals are obtained by passing the transformed reference signals, 50, through frequency filter 55.

Waveform Generator Systems

For waveform generator type systems, which use a synchronizing signal or tachometer signal as input, the input can be assumed to be unity at all frequencies. In this case the above equations can be written more compactly.

The optimal output signals can be written in terms of the error signals as $$x_d = -B(y - y_d(u, e, x_d)). \tag{17}$$

This gives rise to a number of adaption formulae including $$\hat{y} = e - \hat{A}x$$

$$x' = (1-\mu)x - \mu\hat{B}(\hat{y} - y_d) \tag{18}$$

and $$x' = (I - \mu\Lambda)x - \mu\hat{B}(e - y_d) \tag{19}$$

where $\Lambda = I - \hat{B}\hat{A}$ and $\mu$ is the adaption step size.

A diagrammatic view of the control system given by equation (18) is shown in FIG. 7. In this embodiment, the output generator is a waveform generator, 37, synchronized to a frequency signal, 30. When the waveform generator is implemented in the frequency domain, the output is effectively an inverse transform of the harmonic coefficients, 38 (x), of the drive signals. Alternatively the waveform generator may be implemented by filtering sinusoidal reference signals. The residual signals, 23, are transformed in transform module 40 to produce the transformed residual signals, 41 (e). The transform of the estimated original signals, 42 ($\hat{y}$) are produced by subtracting the transformed estimates, 43, of the signals due to the controlling disturbance from the transform of the residual signals. These estimates, 43, are obtained by passing the transformed drive signals, 38, through a model, 44, of the system feedback (which has transfer function $\hat{A}$). The signals 41 and 42, together with the frequency signal, 30, are used in the response generator, 24, to determine the transform of the desired disturbance, 45. The difference between the signals 45 and the signals 42 is passed through the inverse transfer function model, 46 ($\hat{B}$) and used in adaption module 47 to adjust the harmonic transform coefficients, 38, of the drive signal.

Response Generator

By way of explanation we now describe some example response generator.

1. Model Reference Systems

For some systems the original signals at the error sensors are related to the input signals by $$y = Pu + n, \tag{20}$$

where P is a transfer function and n is an additional, unrelated noise.

In some applications the desired residual signal takes the form $$y_d = P_d(e,x)\hat{u}. \tag{21}$$

The desired system response may be fixed, or it may depend upon the drive signals or the residual signals.

The optimal filter is then $$C_{opt} = -B(P - P_d(e,x)), \tag{22}$$

and the update equation can be written in terms of the available signals (using equation (15)) as $$C' = (I - \mu\Lambda)C - \mu\hat{B}(e\hat{u}\ \hat{Q} - P_d(e,x)). \tag{23}$$

2. Spectral Shaping

In some applications it is desirable to shape the power spectrum of the residual signal. The level of the residual signal is set relative to the level at one particular harmonic (such as corresponds to the firing frequency of an internal combustion engine, for example). The magnitude of the desired signal is given by $$|y_d(k)| = \alpha(k).|e(n)|, \tag{24}$$

with $\alpha(n)=0$ for some n and where the $\alpha(k)$ are positive constants and k is the harmonic or frequency number. The phase of the residual can be retained to give $$y_d(k) = \alpha(k) \cdot \frac{|e(n)|}{|e(k)|} \cdot e(k). \tag{25}$$

The corresponding update equation is $$x'(k) = (I - \mu\Lambda) \cdot x(k) - \mu(I - \beta(k))\hat{\beta} \cdot e(k), \tag{26}$$

where $$\beta(k) = \alpha(k) \cdot \frac{|e(n)|}{|e(k)|}. \tag{27}$$

Writing $\mu'(k)=\mu(1-\beta k))$ and $\Lambda'(k)=\Lambda/(1-\beta(k))$ gives $$x'(k)=(I-\mu'(k)\Lambda'(k)).x(k)-\mu'(k)\hat{B}.e(k), \tag{28}$$

which is in the standard form but with parameters which depend upon the frequency and the residual signals.

3. Predetermined Reduction

In other applications it is desirable to cancel some proportion of the noise at some frequencies or harmonics and to increase the noise at other frequencies or harmonics. The desired signal is then related to the uncancelled signal by $$y_d(k)=\gamma(k).y(k)=\gamma.(e-Ax) \tag{29}$$

where $\gamma$ are constants which determined the amount of increase or decrease This type of control may be required, for example ,when there is insufficient actuator power to cancel all of the noise. In that case the constants $\gamma$ are adjusted on-line based on the level of the output signals. The update equation becomes $$x'=(1-\mu)x-\mu(1-\gamma)\hat{B}\hat{y} \tag{30}$$

or equivalently, $$x'=(I-\mu[(1-\gamma)\Lambda+\gamma I])x-\mu(1-\gamma)\hat{B}e. \tag{31}$$

This equation can also be put into the standard form by writing $\mu'(k)=\mu.(1-\gamma(k))$ and $\Lambda'(k)=\Lambda(k)+I\gamma(k)/(1-\gamma(k))$. This gives $$x'(k)=(I-\mu'(k)\Lambda'(k)).x(k)-\mu'(k)\hat{B}e(k). \tag{32}$$

The form in equation (30) is generally preferred since it avoids the need to calculate $\Lambda$, and the range of convergent step sizes is independent of $\gamma$.

4. Control of Harmonic Response.

In this example we consider the case where the physical system is desired to have a specified response. In passive systems for example a target frequency response may be specified. In active systems a desired ham tonic response may be also be specified. In this case the system transfer function, H, can be specified as a function of frequency, f, and harmonic number, k (engine order for example).

The desired output from the system is related to the input by $$y_d(f,k)=H(f,k).\hat{u}(k)=H(f,k).(w(k)-\hat{B}(f)x(k)) \tag{33}$$

This depends upon the input signals, w, and the output signals, x. It further depends upon both the frequency and the harmonic number.

The optimal filter (from equation) is given by $$C_{opt}(f,k)=-\hat{B}(f)(P(f)-H(f,k)) \tag{34}$$

and the corresponding adaption formula is $$C'(f,k)=(I-\mu\Lambda)C(f,k)-\mu\hat{B}(f)(e(k)\hat{u}(k)Q-H(f,k)) \tag{35}$$

The particular form of the response generator will depend upon the application. In some applications the desired response may depend upon additional parameters, such as the speed, load or throttle position of an automobile engine. These may easily be included into the control system described herein.

Another application for this type of control system is in audio systems. In many to audio systems the perceived spectrum of the music output from the loudspeakers is dependent upon the loudness of the input signal. This is due partly to non-linearities in the reproduction system and partly due to perceived loudness by listeners. Many systems are supplied with graphic equalizers which enable the user to boost or attenuate various parts of the system, but it is inconvenient to adjust the equalizer each time the volume level is altered. A control system of this type can be configured to monitor the sound produced by the loudspeakers and adjust the input signal so that the perceived spectrum of the sound has the desired relationship to the input signal.

Having described the preferred embodiment of the invention it should be obvious to those of ordinary skill in the art that many changes, substitutions and modifications can be made without departing from the scope of the appended claims.

I claim:

1. A control system for altering the frequency or harmonic spectra of an original disturbance so as to produce a desired disturbance with desired frequency or harmonic spectra said system comprising at least one actuator means for generating a controlling disturbance, at least one sensor means responsive to the net controlled disturbance and producing first signals, and output generator means responsive to said first signals and producing drive signals for said actuator means, and response generator means adapted to produce second signals characterizing a desired net controlled disturbance having a specified frequency or harmonic spectrum, characterized in that the output generator means is responsive to said first signals and said second signals so as to shape the controlled disturbance to the desired frequency or harmonic spectra.

2. A control system as in claim 1 wherein the original disturbance comprises noise inside a vehicle cabin.

3. A control system as in claim 1 configured to alter the frequency spectrum of an input electronic signal applied to a non-linear system so as to maintain the frequency spectrum of the output of said non-linear system in a preferred relationship to said input electronic signal.

4. A control system as in claim 1 further characterized in that said response generator means is responsive to said first signals and said drive signals.

5. A control system as in claim 1 in which said output generator means is adjusted in response to the difference between said second signals and said first signals.

6. A control system as in claim 1 in which said output generator means is adjusted in response to the difference between said second signals and an estimate of the components of said first signals which are due to the original disturbance without control.

7. A control system as in claim 1 in which said response generator means is responsive to signals derived from a frequency transform of said first signals and a frequency transform of said drive signals.

8. A control system as in claim 1 in which said output generator means comprises adaptive filter means adjusted in response to the frequency or harmonic transforms of said first signals and said second signals.

9. A control system as in claim 1 in which the second signals characterize a frequency transform of the desired disturbance.

10. A control system as in claim 1 in which the transform of the desired disturbance at each frequency or harmonic is made proportional to the amplitude of the transform of the corresponding first signal at a preselected frequency or harmonic.

11. A control system as in claim 1 in which the transform of the desired disturbance at each frequency or harmonic has the same phase as the transform of the corresponding residual signal at the same frequency or harmonic.

12. A control system as in claim 1 in which the transform of the desired disturbance at each frequency or harmonic is made directly proportional to the transform of the corresponding estimated original disturbance without control.

13. A control system as in claim 1 in which each second signal is obtained by filtering the corresponding first signal.

14. A control system as in claim 1 in which the second signals are obtained by filtering estimates of the components of the first signals due to the original disturbance.

15. A control system as in claim 1 in which said output generator means comprises an adaptive filter means responsive to an estimate of the components of the first signals which are due to the original disturbance without control.

16. A control system as in claim 1 wherein said output generator means comprises an adaptive filter means responsive to an estimate of the components of the first signals which are due to the original disturbance without control, and additional sensor means producing third input signals related at least in part to said original disturbance, and characterized in that said adaptive filter means is responsive to said third input signals.

17. A control system as in claim 16 in which the adaptive filter means are responsive to the frequency or harmonic transform of said third signals and said drive signals are obtained by an inverse frequency transform or inverse harmonic transform of the output of said adaptive filter means.

18. A control system as in claim 1 of said desired specified frequency or harmonic spectrum noise from the exhaust and/or inlet of a machine.

19. A control system as in claim 1 for controlling a substantially periodic disturbance, said system additionally including frequency measuring means for providing one or more synchronizing signals related to the frequencies of the original disturbance, and further characterized in that said output generator means is synchronized to said synchronizing signals.

20. A control system as in claim 19 in which the response generator means is responsive to signals derived from the harmonic transforms of said first signals and the harmonic transforms of said drive signals, said harmonic transforms being synchronized to said synchronizing signals.

21. A control system as in claim 19 in which the second signals characterize the harmonic transform of the desired signals.

22. A method of altering the frequency or harmonic spectra of a controlled disturbance comprising producing a first set of signals in response to said controlled disturbance, producing drive signals for an actuator adapted to produce an inverse counter disturbance so as to attenuate said controlled disturbance, shaping said controlled disturbance to a desired frequency or harmonic spectra, and producing second signals representative of a desired specified frequency or harmonic spectrum of said controlled disturbance, in response to said first signals and said drive signals and wherein the shaping of said desired specified frequency or harmonic spectrum is influenced by said first signals and said drive signals.

23. A method as in claim 22 and including the step of filtering said first signals to obtain said second signals.

24. A method as in claim 22 and including the steps of measuring the frequency of said original disturbance and providing synchronizing signals related to the frequencies of the disturbance.

25. A method as in claim 22 including providing said second signals in response to said first signals and said drive signals and adjusting continually said drive signals to reduce the difference between said second signals and said first signals.

26. A method as in claim 22 including providing said second signals in response to said first signals and said drive signals, providing an estimate of the components of said first signals due to the original disturbance without control, and adjusting the drive signals in response to the difference between said second signals and said estimate so as to shape said controlled disturbance signals.

27. A method as in claim 22 including producing said second signals in response to a frequency transform of said drive signals and a frequency transform of said first signals.

28. A method as in claim 22 including producing said second signals by filtering said first signals and said drive signals, and producing input signals in response, in part, to said controlled disturbance, filtering said input signals to produce said drive signals.

29. A method as in claim 28 wherein said filtering is adapted in response to signals from said first signals, second signals and third signals.

30. A method as in claim 29 wherein said response adapting said filtering is caused by a frequency or harmonic transform of said third signals and an inverse frequency or harmonic transform of said filtering step output.

* * * * *